US006537161B2

(12) United States Patent
Manix et al.

(10) Patent No.: US 6,537,161 B2
(45) Date of Patent: Mar. 25, 2003

(54) PORTABLE BASKETBALL RETURN APPARATUS

(76) Inventors: Paul D. Manix, 22627 Hatteras, Woodland Hills, CA (US) 91367; Mary D. Manix, 22627 Hatteras, Woodland Hills, CA (US) 91367

( * ) Notice: Subject to any disclaimer, the term of this patent is extended or adjusted under 35 U.S.C. 154(b) by 0 days.

(21) Appl. No.: 09/863,702

(22) Filed: May 23, 2001

(65) Prior Publication Data

US 2002/0177496 A1 Nov. 28, 2002

(51) Int. Cl.[7] ..... A63B 69/00
(52) U.S. Cl. ..... 473/433; 473/431
(58) Field of Search ..... 473/433, 432, 473/431, 434, 435

(56) References Cited

U.S. PATENT DOCUMENTS 1,765,269 A * 6/1930 Hatley
2,808,264 A 10/1957 Scalf
3,233,896 A * 2/1966 King
3,799,543 A 3/1974 Steele, Jr.
3,814,421 A 6/1974 Spier
3,945,638 A 3/1976 Luebkeman
4,579,339 A 4/1986 Grimm
4,706,954 A 11/1987 Kershaw
4,786,052 A * 11/1988 Zinger
4,786,371 A * 11/1988 Postol
4,896,882 A * 1/1990 Coleman
4,957,289 A * 9/1990 Kotlarz
5,098,090 A * 3/1992 Juhl
5,141,224 A * 8/1992 Nolde et al.
5,184,814 A * 2/1993 Manning
5,265,870 A * 11/1993 Merino
5,312,099 A * 5/1994 Oliver, Sr.
5,348,290 A * 9/1994 Matherne et al.
5,540,428 A * 7/1996 Joseph
5,779,569 A * 7/1998 Townsend et al.
5,830,088 A 11/1998 Franklin de Abreu
5,833,234 A * 11/1998 Vavala et al.
6,056,652 A * 5/2000 Lees et al.
6,074,313 A * 6/2000 Pearson

* cited by examiner

*Primary Examiner*—Paul T. Sewell
*Assistant Examiner*—Nini F. Legesse
(74) *Attorney, Agent, or Firm*—Sanford Astor

(57) ABSTRACT

A portable basketball return apparatus adapted to be attached to a rim attached to a backboard by a bracket, comprising, a holding clamp for attachment of the apparatus to the bracket, a spine attached to said holding clamp, a return panel attached to said spine, said holding clamp comprising an upper plate and a lower plate adapted to fit over said bracket, a screw passing through said lower plate, pole means to lift the apparatus, from the ground onto the bracket and to rotate the screw to tighten the holding clamp onto the bracket.

20 Claims, 11 Drawing Sheets

FIG. 3
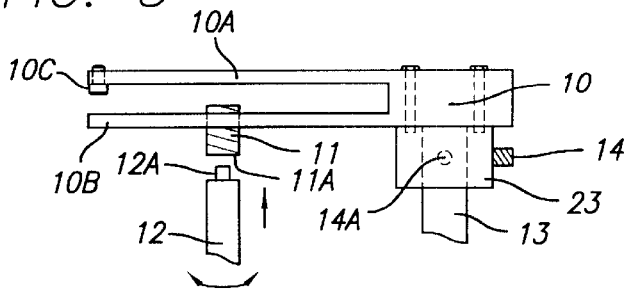
FIG. 4
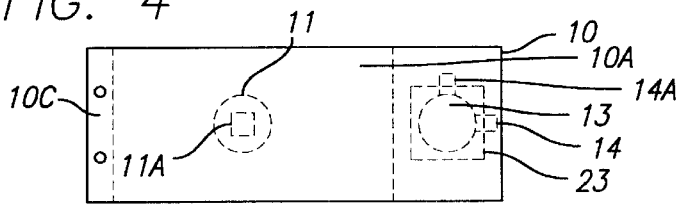
FIG. 5
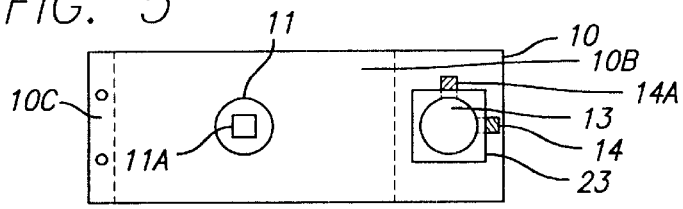
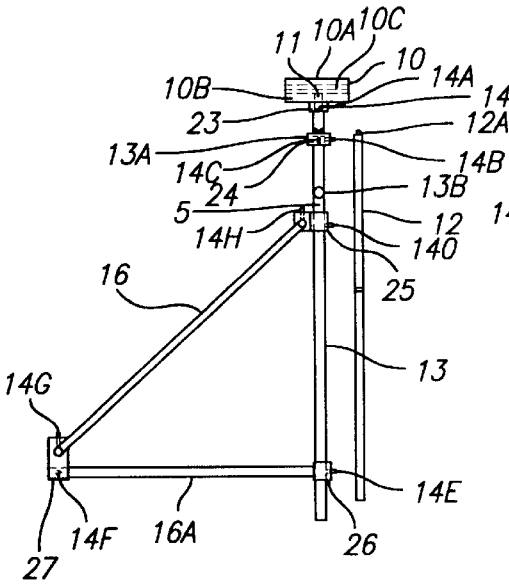
FIG. 6
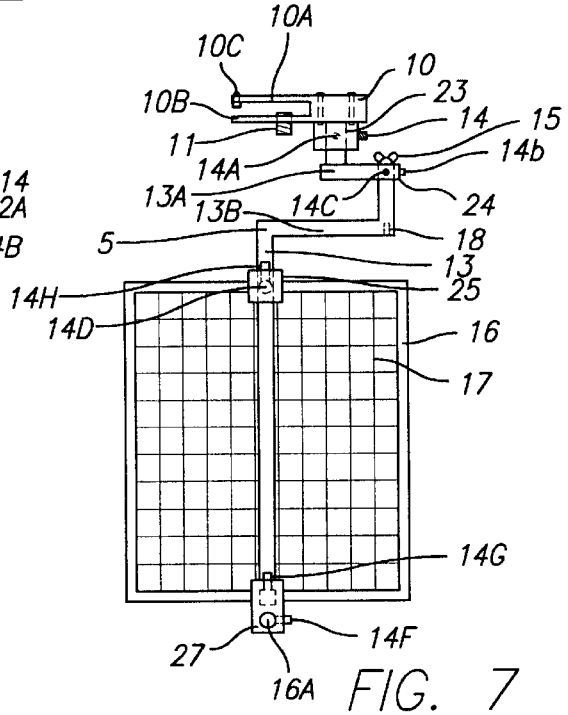
FIG. 7

FIG. 15
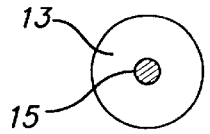
FIG. 16
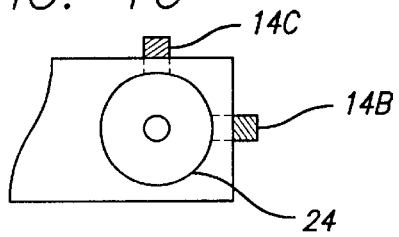
FIG. 17
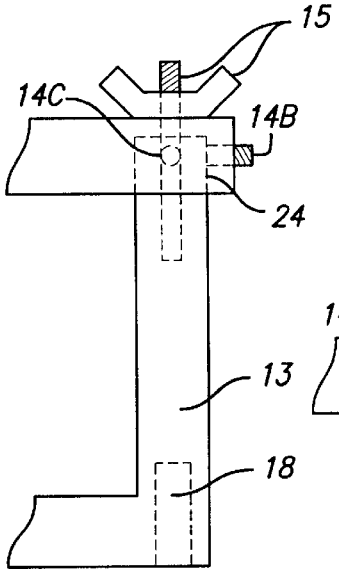
FIG. 18
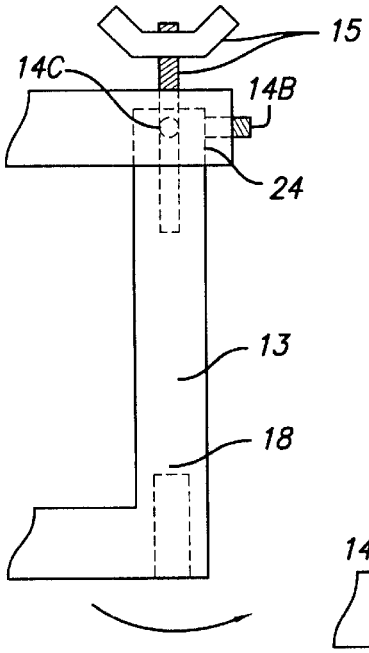
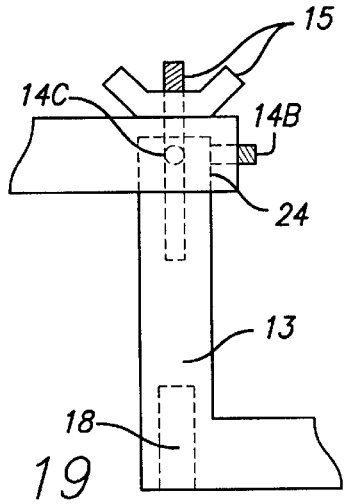
FIG. 19

PORTABLE BASKETBALL RETURN APPARATUS

This invention has been described in our Disclosure Documents No. 479179 filed Aug. 31, 2000 and No. 491436 filed Apr. 2, 2001.

BACKGROUND OF THE INVENTION

Several devices have been suggested for returning the basketball to the shooter. Variations on ball return chutes disposed below and behind the basketball rim have been suggested in U.S. Pat. Nos. 4,706,954; 4,579,339; 3,945,638; 3,814,421; 3,799,543; and 2,808,264. Steel's U.S. Pat. No. 3,799,543 suggests a ball deflector disposed behind the net and magnetically attached to the underside of the rim. Kershaw's U.S. Pat. No. 4,706,954 interferes with the basketball's natural trajectory. The device's hooks go over the rim. When the basketball hits one of these hooks, either on the fly or by bouncing on the rim, the ball will ricochet unnaturally. Also, in order to install and take down this device, additional equipment is needed, such as a ladder. Not many children carry a ladder around the playground. Additionally, all of the above devices involve substantial problems, such as disabling the basket, the need for equipment for installation and removal, or they are too complex in their approach.

SUMMARY OF THE INVENTION

The Portable Basketball Return apparatus of this invention is portable, needs no outside equipment to install and can be installed and removed from the ground, in seconds. The Portable Basketball Return apparatus is positioned and secured to the basketball rim's horizontal upper bracket and operates over a 180 degree field. The apparatus hangs from the basketball rim's horizontal upper bracket and does not interfere with the ball's trajectory. It returns the ball from a successful shot back to the shooter. It can also be adjusted so it returns the ball to either side of the basket, over a 180 degree field. It improves the shooter's workout, because the shooter spends more time shooting the ball, without the need to retrieve the ball after each shot. The shooter gets rewarded by getting the ball back when he or she makes a basket. The shooter can practice his or her favorite shot from anywhere on the court, and do so over and over again without having to retrieve the ball. The shooter can practice bank shots, hook shots or bank hook shots without wasting time retrieving the basketball. The Portable Basketball Return apparatus can also be equipped with a sensor and/or digital counting display, to keep count of the baskets, which adds pleasure and enhances the workout.

The Portable Basketball Return apparatus of this invention slides onto the horizontal bracket of the basketball rim from the side and hangs down from the basketball rim's horizontal bracket. To install the apparatus the installer slides the apparatus into place from the ground, using a pole. A flat topped screw with a square female receptacle is manipulated with the pole, which is equipped with a square male extension that fits snugly into the female counterpart on the screw. As the shooter turns the screw, it extends upward under the rim's horizontal bracket, squeezing the bracket against the top plate of the apparatus' holding clamp, securing it into place. The pole is removed once the apparatus is secured in place.

A panel with elastic material hangs down below the basketball rim at an approximate 45 degree angle. When the shooter makes a basket and the ball clears the net it comes into contact with the elastic in the panel, which kicks the basketball back to the shooter. The shooter can stand three to twenty five feet away from the rim and shoot shot after shot without having to retrieve the ball each time. The shooter can make a quick, simple adjustment to swivel the panel in any direction desired and can shoot from either side of the basket or in front of it. The panel can rotate 360 degrees, but the shooter only needs 180 degrees to shoot anywhere on the court.

A sensor and a digital counter can keep count of the baskets made by the shooter. It is an extremely entertaining form of exercise. When the shooter is done, the apparatus can be easily removed by simply loosening the screw with the pole and taking the apparatus down, which takes only seconds.

OBJECTS OF THE INVENTION

Accordingly, besides the objects and advantages of the Portable Basketball Return apparatus described above, several objects and advantages of the present invention are:

(a) to provide more vigorous exercise period of concentrated basketball shooting;

(b) to provide a fun exercise workout;

(c) to provide a way to tally the baskets scored;

(d) to provide a basketball return device that can be installed without additional equipment;

(e) to provide a basketball return adjustable to the shooter's favorite spot on the court;

(f) to provide a portable device that a man, woman or child can install and remove in seconds, while standing on the ground.

BRIEF DESCRIPTION OF THE DRAWINGS

FIG. 3 is a side view of the holding clamp and screw;

FIG. 4 is a top view of the holding clamp;

FIG. 5 is a bottom view of the holding clamp.

FIG. 6 is a side view of the Portable Basketball Return apparatus;

FIG. 7 is a front view thereof;

FIG. 15 is an end view of the male locking device;

FIG. 16 is an end view of the female portion of the locking device;

FIG. 17 is a side view of the spine adjustment system in a locked position;

FIG. 18 is a side view of the spine adjustment system in an unlocked position;

FIG. 19 is a side view of the adjustment system with the spine swiveled to an alternate locked position;

DETAILED DESCRIPTION OF THE DRAWINGS

Figure 1:
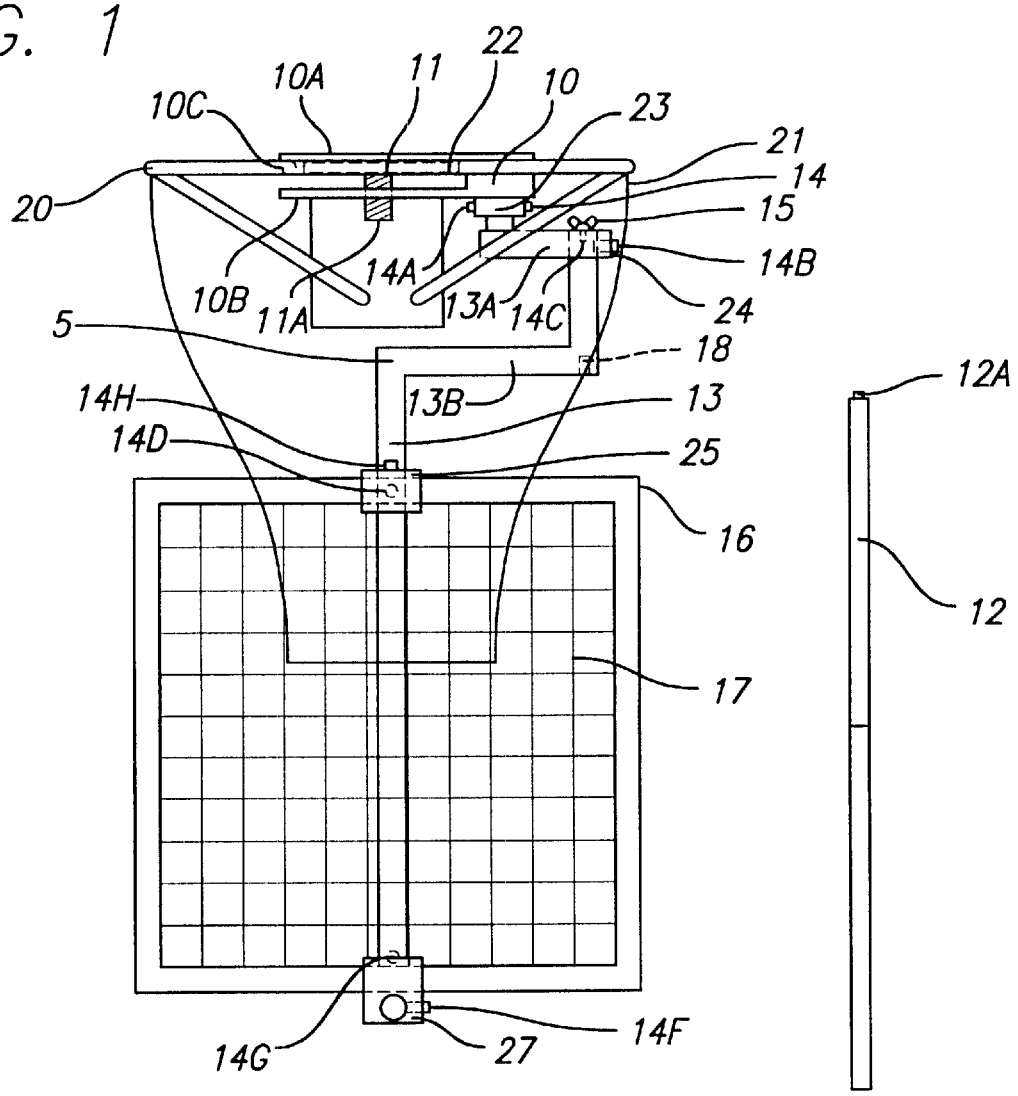
FIG. 1 is a front view of the Portable Basketball Return apparatus attached to a basketball rim in the frontal position.

Referring now to the drawings, there is shown in FIGS. 1–7, Portable Basketball Return apparatus 5 attached to horizontal bracket 22 of basketball rim 20, which is attached to backboard 30. Net 21 is attached to rim 20. Apparatus 5 is attached to rim 20 by inserting pole 12, having male fitting 12A, into female receptacle 18, lifting apparatus 5 and sliding U-shaped holding clamp attachment bracket 10, having upper plate 10A and lower plate 10B, onto horizontal bracket 22. Once apparatus 5 is in place on rim 20's horizontal bracket 22, apparatus 5 is tightened onto horizontal bracket 22 by using pole 12 to tighten screw 11, which pushes against horizontal bracket 22 and secures bracket 22 between screw 11 and upper plate 10A of attachment bracket 10. Lip 10C prevents holding clamp 10 from sliding off of horizontal bracket 22. When the shooter is done with the workout, he or she simply loosens screw 11 with pole 12 and slides apparatus 5 away from horizontal bracket 22 to take the apparatus down.

Figure 2:
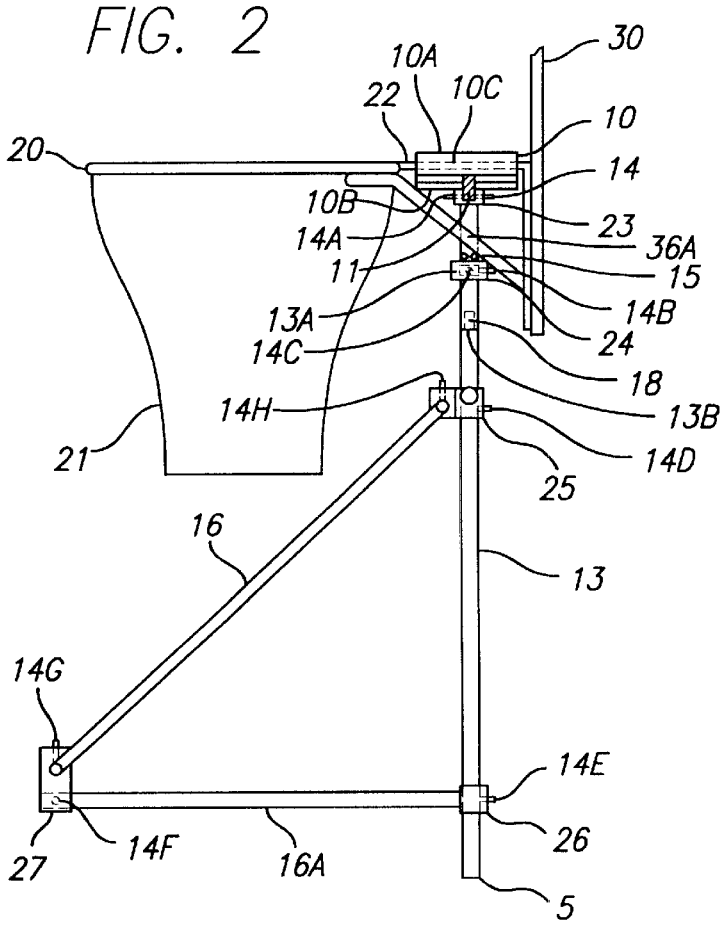
FIG. 2 is a side view thereof.
Figure 2A:
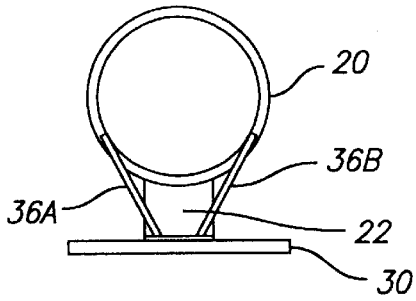
FIG. 2A is a top view of the rim, bracket and backboard.
Figure 2B:
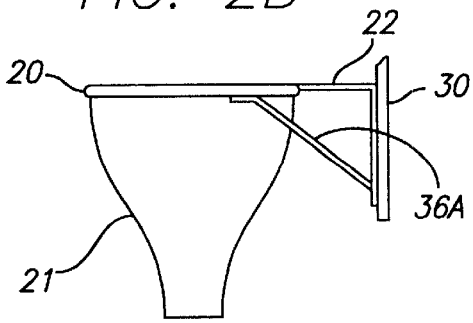
FIG. 2B is a side view of the rim, bracket and backboard.

FIG. 2A and FIG. 2B show a standard rim 20 with net 21 and backboard 30 with support brackets 36A and 36B. FIG. 2 shows apparatus 5 in position on basketball rim's 20 horizontal bracket 22. FIG. 3 shows attachment bracket 10, which comprises upper plate 10A, lower plate 10B, lip 10C, screw 11 and pole 12. Spine 13 depends from attachment bracket 10. Cup point socket screws 14 and 14A hold spine 13 in swivel socket 23 which is attached to holding clamp attachment bracket 10 and allow for rotation of spine 13. FIG: 4 shows a top view of attachment bracket 10 showing upper plate 10A with screw 11 and spine 13 in phantom. FIG. 5 shows a bottom view of attachment bracket 10 showing lower plate 10B with screw 11, spine 13, swivel socket 23 and tightening cup point screws 14 and 14A.

FIG. 6 shows a side view of apparatus 5 with attachment bracket 10, screw 11, pole 12, spine 13 and return panel 16. Return panel 16 is affixed to spine 13 by swivel sockets 25 and 26, held by cup point screws 14D, and 14E. Horizontal leg 16A of return panel 16 holds return panel 16 at about a 45 degree angle, however the exact angle can be varied between about 20 degrees to 80 degrees, at the choice of the shooter, depending upon how he or she wants the ball returned, by adjusting swivel sockets 25 and 27 with cup point screws 14D, 14F, 14G and 14H.

FIG. 7 shows the entire apparatus 5 not attached to a basketball rim. Return panel 16 can swivel around spine 13 by the use of swivel sockets 25 and 26. In this way return panel 16 can rotate 360 degrees around spine 13, although about 180 degrees is usually all that would be desired. Swivel socket 27, held by cup point screws 14F and 14G, allows adjustment of the angle of return panel 16 and allows horizontal leg 16A to be removed for portability. Return panel 16 has elastic material 17 which kicks the basketball back to the shooter after a successful shot.

Figure 8:
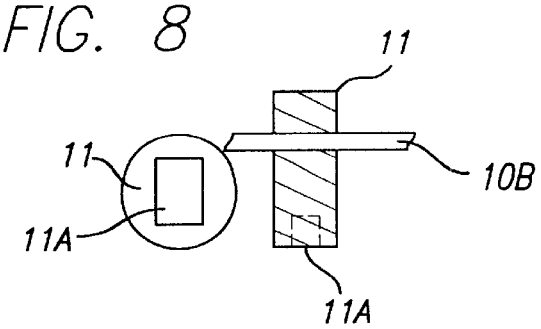
FIG. 8 is a detailed view of the securing screw and female receptacle.
Figure 9:
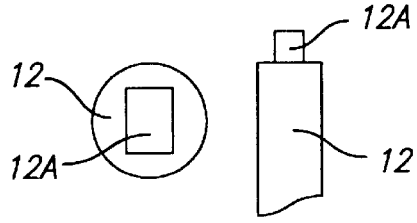
FIG. 9 is a detailed view of the pole tip with the male extension for turning the screw.

FIG. 8 shows a detailed view of screw 11 mounted in lower plate 10B of bracket 10 and its square female receptacle 11A in the bottom of screw 11. FIG. 9 shows a detailed view of the top of pole 12 and it's square male extrusion 12A on the top of pole 12.

Figure 10:
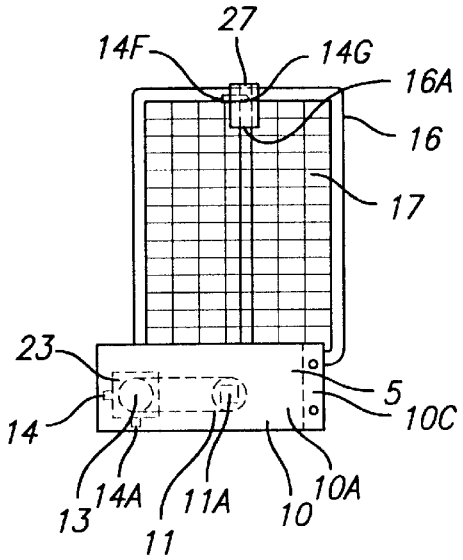
FIG. 10 is a top view of the Portable Basketball Return apparatus.

FIG. 10 shows upper plate 10A of holding clamp 10 showing spine 13 and screw 11. Return panel 16 holds elastic material 17 which causes the basketball to return bounce to the shooter. Also shown are spine swivel socket 23 which allows.spine 13 to be adjusted for various return positions, and cup point socket screws 14 and 14A which lock and unlock swivel socket 23. Also shown are horizontal return panel support 16A and return panel swivel socket 27.

Figure 11:
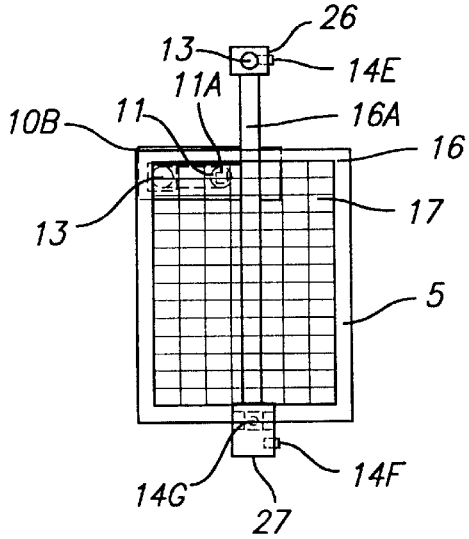
FIG. 11 is a bottom view of the Portable Basketball Return apparatus.

FIG. 11 is a bottom view showing the lower plate 10B of holding clamp attachment bracket 10, return panel swivel sockets 26 and 27 and horizontal return panel support 16A. FIG. 11 also shows spine 13 and screw 11.

Figure 12:
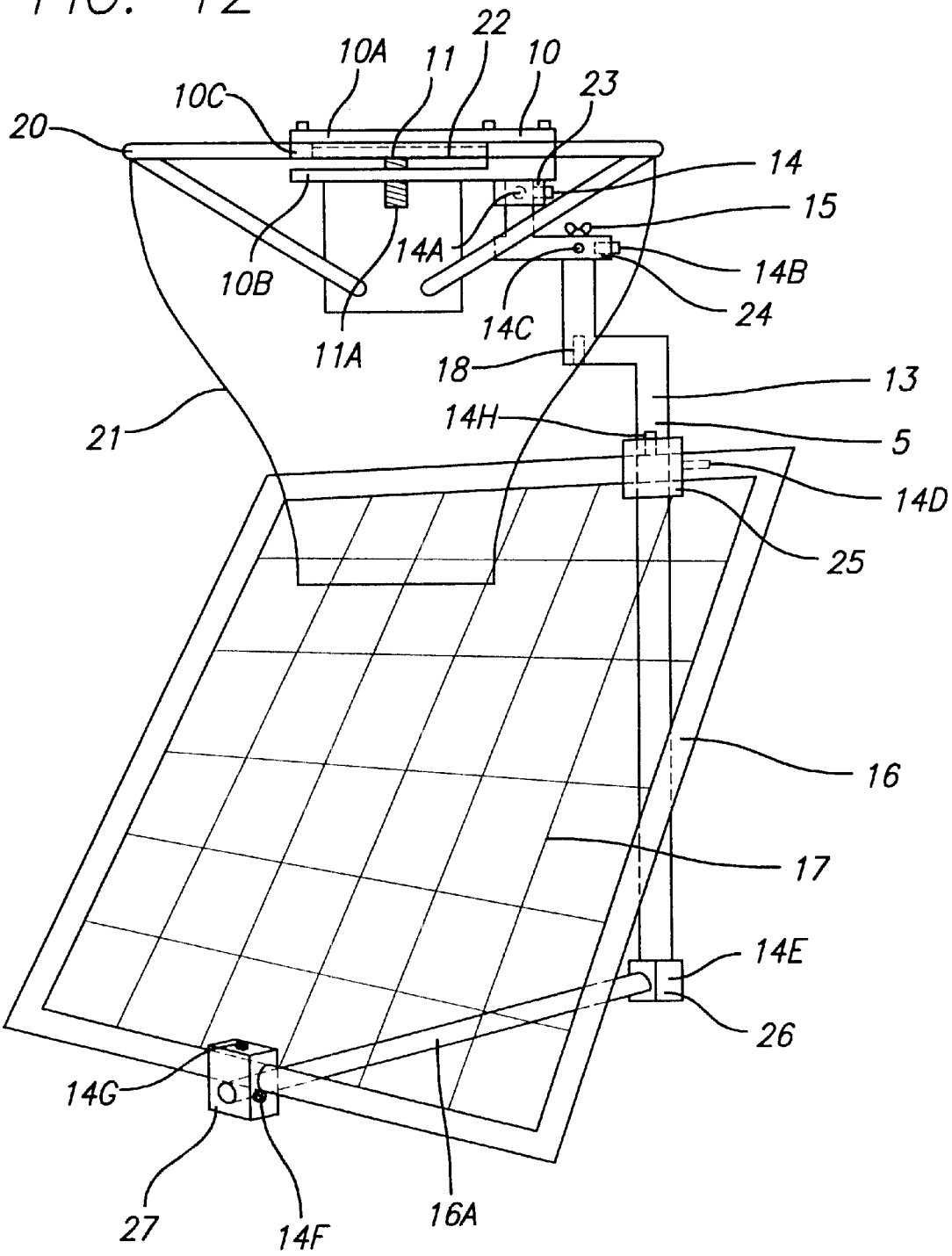
FIG. 12 is a front view of the Portable Basketball Return apparatus attached to a basketball rim with the return panel in a ¾ position.

FIG. 12 shows return panel 16 at a 45 degree angle, between the foul line and the edge of the court, for shooting baskets from the left of center. There is shown rim 20 and net 21. Return panel 16 holds elastic material 17. Return panel 16 is supported by spine 13, and horizontal support member 16A. Return panel 16 is moved to this position by releasing cup point screws 14, 14A, 14B, 14C, 14D, 14E and wing nut 15, releasing swivel sockets 23, 24, 25, and 26, adjusting spine 13 to the appropriate position, rotating return panel 16 to the 45 degree position and tightening cup point screws to lock all swivel sockets.

Figure 13:
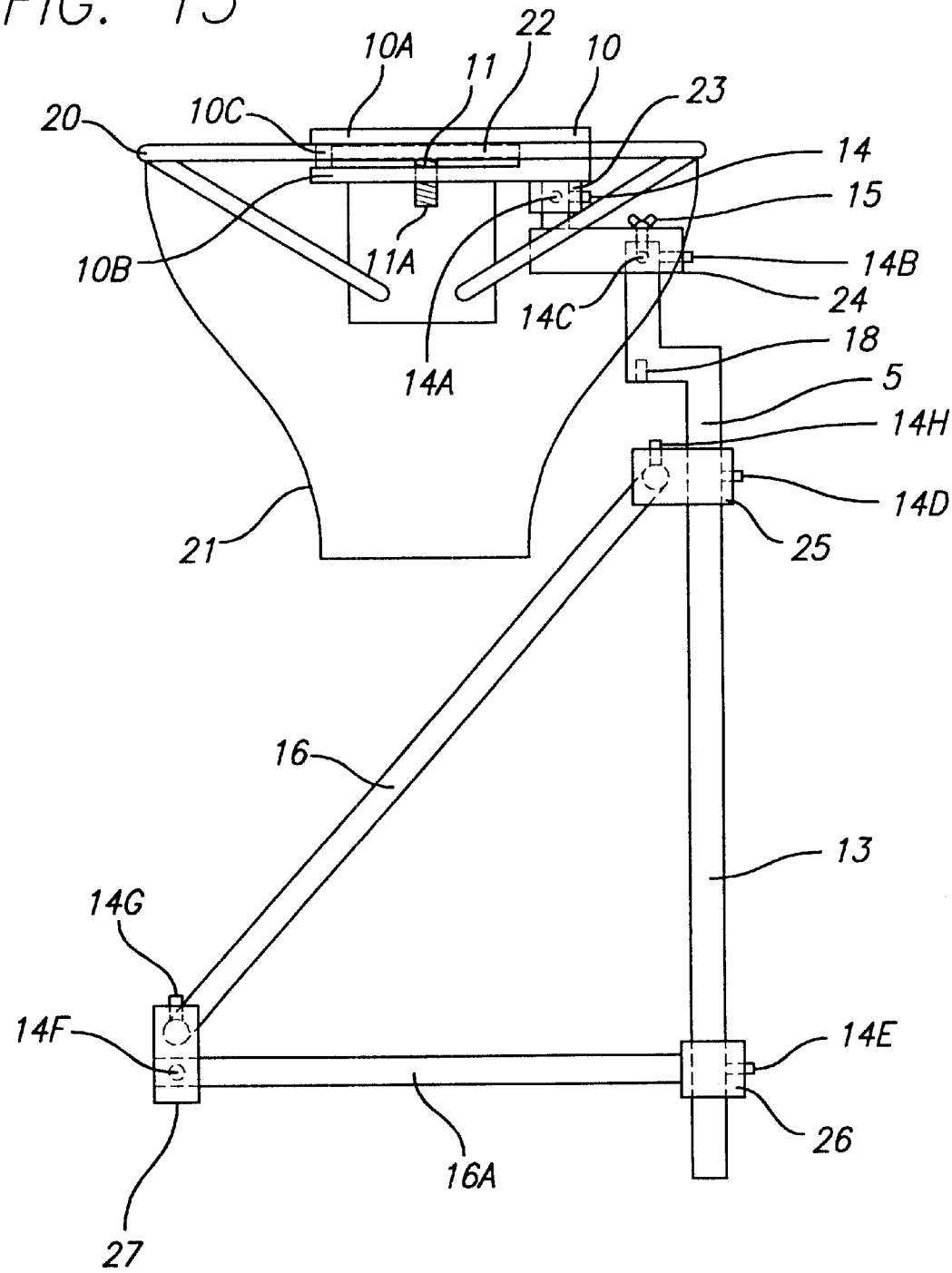
FIG. 13 is a front view of the Portable Basketball Return apparatus attached to a basketball rim with the return panel in the right side position, parallel to the baseline.

FIG. 13 shows return panel 16 positioned for shooting from the side at a 90 degree angle from the center, along or parallel to the left baseline. Again, this is accomplished by releasing the above mentioned cup point socket screws and swivel sockets, rotating return panel 16 to the 90 degree position and tightening all of the cup point screws and swivel sockets.

Figure 14:
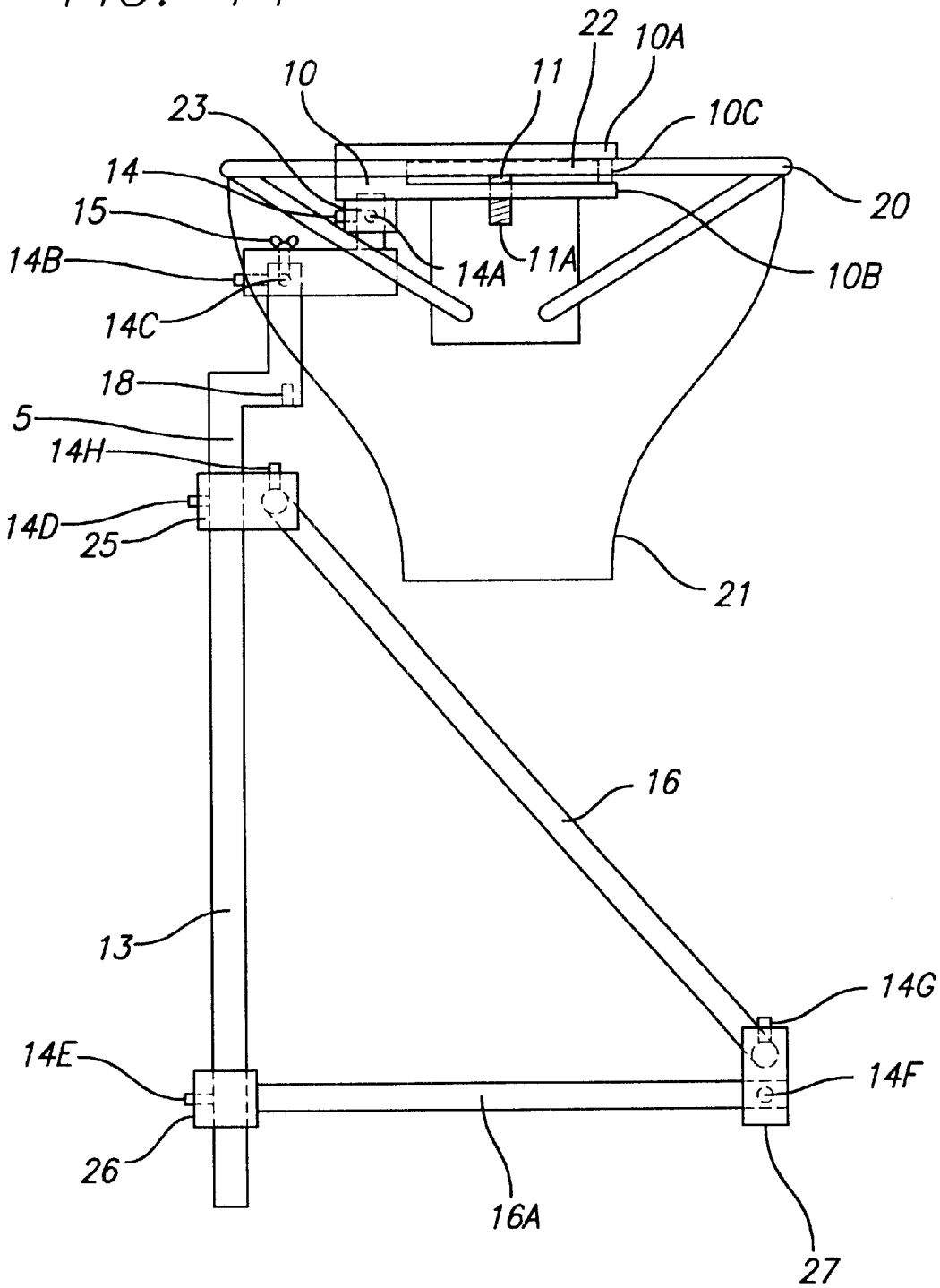
FIG. 14 is a front view of the Portable Basketball Return apparatus attached to a basketball rim with the return panel in the left side position.
Figure 20:
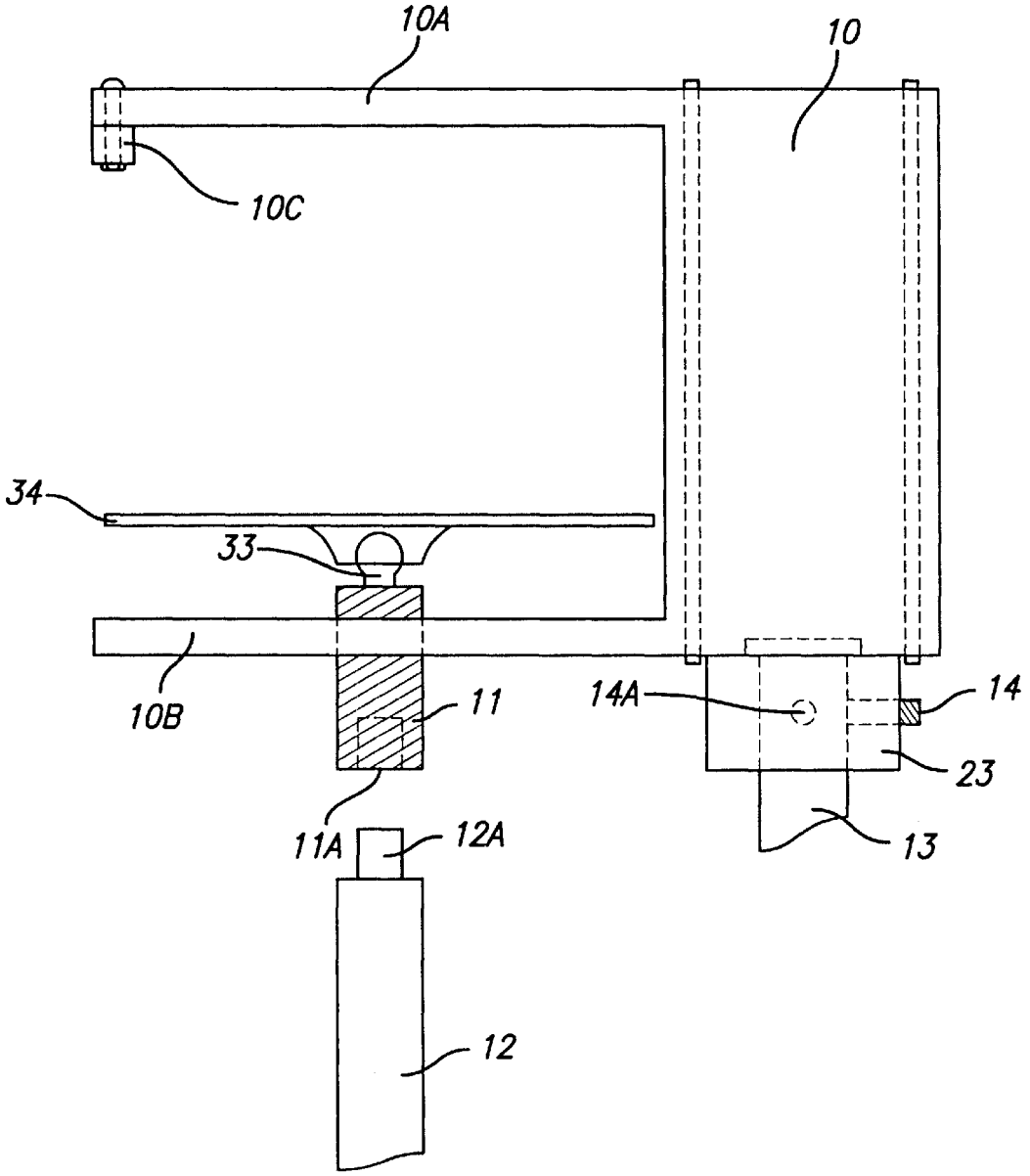
FIG. 20 is a side view of an alternate locking mechanism.
Figure 21:
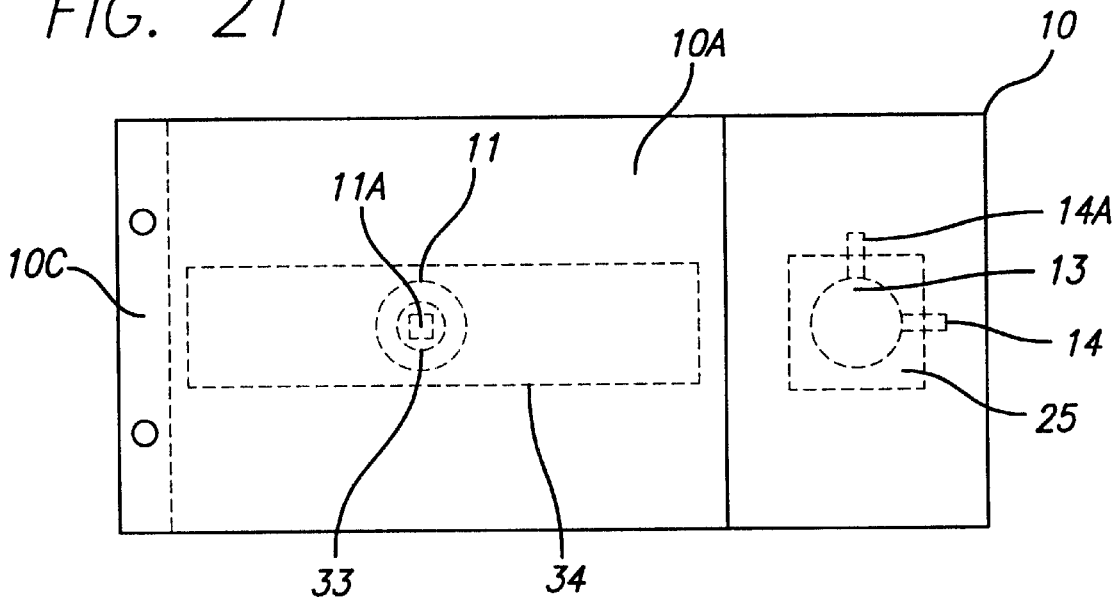
FIG. 21 is a top view of the alternate locking mechanism.
Figure 22:
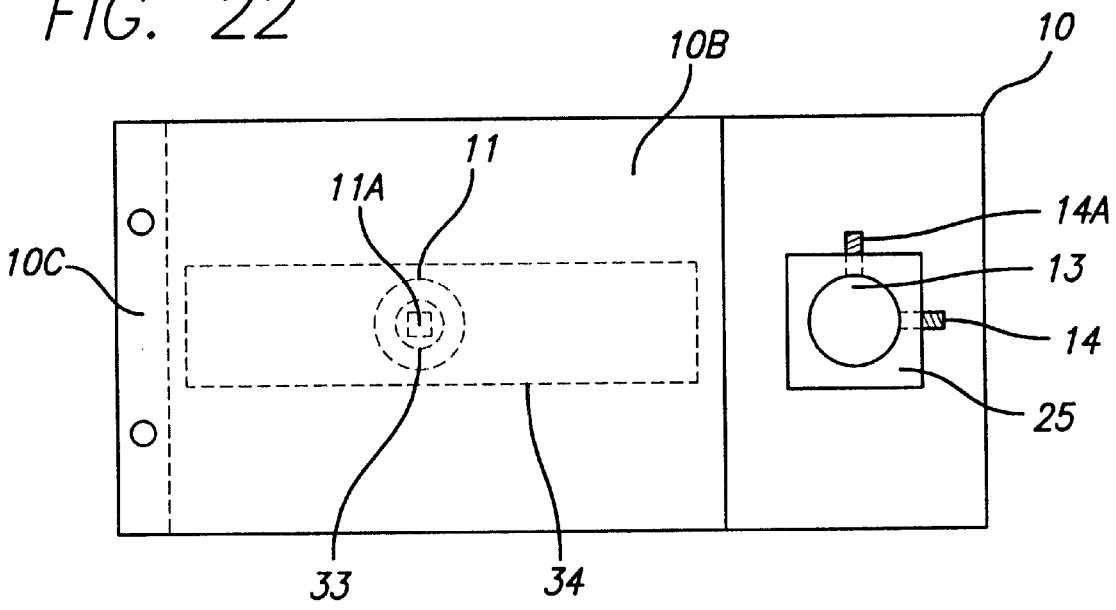
FIG. 22 is a bottom view of the alternate locking mechanism.
Figure 23:
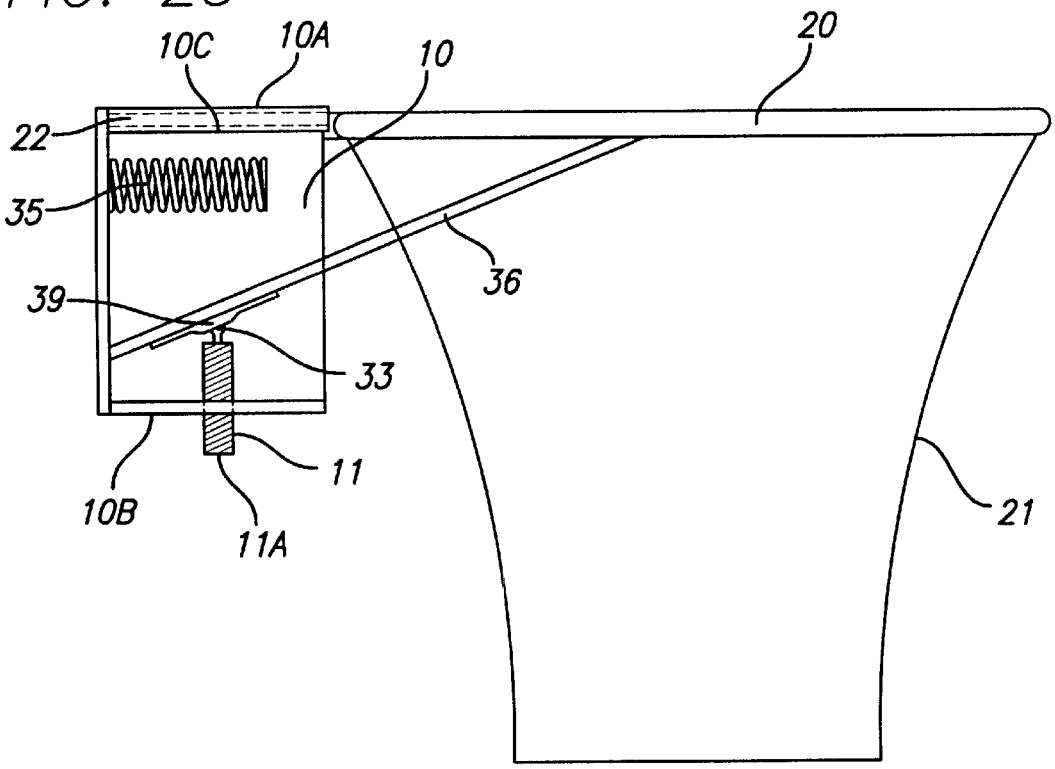
FIG. 23 is a side view of the alternate locking mechanism attached to the rim.
Figure 24:
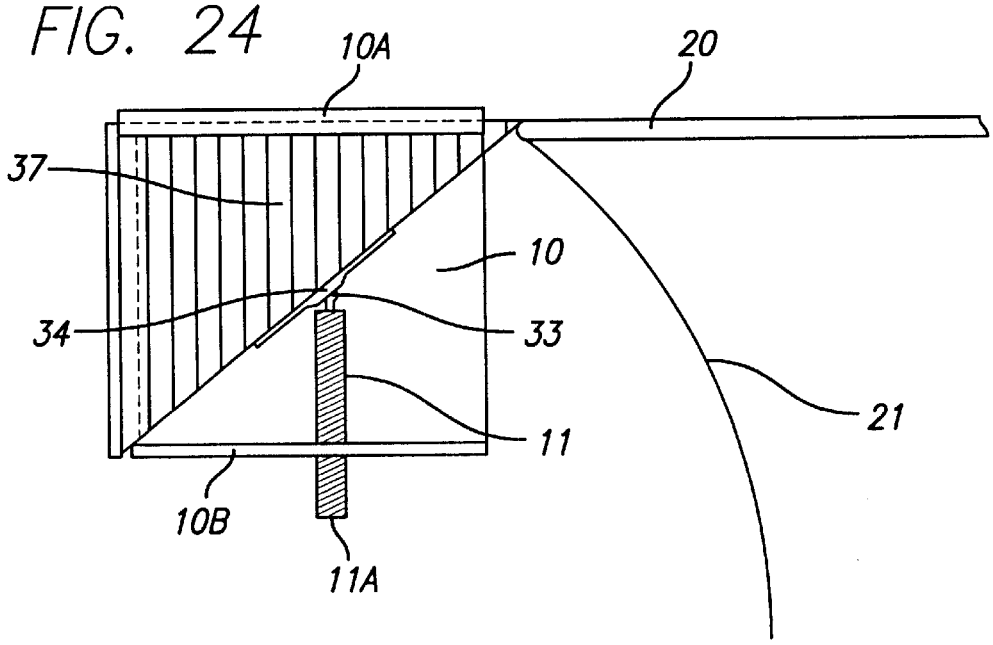
FIG. 24 is a side view of the alternate locking mechanism on another type of rim.

FIG. 14 is a front view of the rim with return panel frame 16 positioned for 90 degree side shooting parallel to the right baseline. Adjustment is made as described above in FIGS. 12 and 13.

FIGS. 15 through 19 shows the adjustment of spine 13 at swivel socket 24. To get return panel 16 into the proper position to return the ball, 180 degrees from the shooter's position, spine 13 needs to be centered behind the rim so that the ball strikes elastic panel 17 in the center of return panel 16. Wing nut 15 and cup point screws 14B and 14C are released to allow rotation of spine 13 in swivel socket 24. Upper horizontal member 13A is recessed to form swivel socket 24 which receives the top of spine 13. Horizontal members 13A and 13B place spine 13 back away from being directly under rim 20, where it would interfere with the ball. Wing nut 15 stops spine 13 from falling out of upper horizontal member 13A.

To install the apparatus the shooter slides holding clamp 10 onto rim 20's upper horizontal bracket 22 from the side, using retractable pole 12, with male fitting 12A fitted into female receptacle 18 in spine 13. Upper plate 10A goes above horizontal bracket 22 and lower plate 10B goes below horizontal bracket 22. The shooter uses retractable pole 12 to turn screw 11 by placing square male fitting 12A into female receptacle 11A of screw 11 and turning pole 12, which moves screw 11 up against horizontal bracket 22.

Horizontal bracket 22 is sandwiched between screw 11 and upper plate 10A of holding clamp 10, securing the entire apparatus 5 in place.

Return panel 16 is adjustable. It can rotate 360 degrees around spine 13 and can be locked into place via two swivel sockets 25 and 26. The spine 13 can be manipulated by releasing swivel sockets 23 and 24. By manipulating spine 13, return panel 16 and holding clamp 10, the ball can be returned to any area of the basketball court that the shooter desires; toward the free throw line, along the baseline or any point in-between. If the shooter is practicing side shots on the right hand side of the basket and wants to shoot side shots on the left side of the basket, he or she simply reverses holding clamp 10 from the right side of horizontal bracket 22 to the left side of horizontal bracket 22 and makes adjustments to spine 13 and return panel 16.

The shooter then shoots the basketball from a favorite position on the court, and when the basket is made, the ball comes into contact with elastic material 17 of return panel 16, which is hanging below the rim at an approximate 45 degree angle. The shooter can shoot basket after basket and the ball is returned each time he or she makes it. At the end of the workout the shooter uses the pole 12 to loosen screw 11 and takes the entire apparatus 5 down.

FIGS. 20–24 show an alternate attachment mechanism specifically for those rims that have a horizontal bracket which is not reachable in the manner.described above. Some rims have a spring 35 below horizontal bracket 22 (see FIG. 23) which prevent apparatus 5 from being installed as described above. Some rims are attached by a triangular shaped box, such as box 37 of FIG. 24 which fit over the horizontal bracket. In order to attach the return apparatus to either one of these type of rims, a movable plate 34 is attached to screw 11 through a ball socket 33, (see FIG. 20) which allows plate 34 to rotate to the angle necessary to press firmly against brackets 36A and 36B (see FIG. 2) or box 37, to hold return apparatus 5 in place. Everything else about the return apparatus remains the same as described in FIGS. 1–20.

Accordingly, it is seen that the Basketball Return Apparatus is an entertaining way to shoot basketballs while getting a vigorous and fun workout. The device allows the shooter to concentrate on shooting technique, while not having to chase the ball after each shot. It is portable and needs no additional equipment to put up or take down. Of particular benefit is that it does not require a ladder for installation or removal.

Although the description above contains specific embodiments, these should not be construed as limiting the scope of the invention, but merely providing illustrations as some of the presently preferred embodiments of this invention. The Portable Basketball Return Apparatus can be made of any material, such as, plastic, aluminum, wood, graphite or steel. The shape of the return panel can be any shape, such as circular, square, oval, trapezoidal or triangular, etc. Thus the scope of the invention should be determined by the appended claims and their legal equivalents, rather than by the examples given.

We claim:

1. A portable basketball return apparatus releasably attachable to a rim attached to a backboard, to return a basketball to a shooter comprising, a holding clamp for attachment of the apparatus to the rim, a spine attached to said holding clamp, a return panel attached to said spine, in which said spine has four elbow joints allowing said spine to be rotated in two separate sections.

2. A portable basketball return apparatus releasably attachable to a rim attached to a backboard, to return a basketball to a shooter comprising, a holding clamp for attachment of the apparatus to the rim, a spine attached to said holding clamp, a return panel attached to said spine, in which said spine is rotatable 360 degrees, said return panel being attached to said spine by rotatable socket screws, allowing said return panel to rotate 360 degrees around said spine, in which said return panel has a horizontal support leg connected to said panel by socket screws, allowing said return panel to be disconnected from said spine for ease of portability.

3. A portable basketball return apparatus releasably attachable to a rim attached to a backboard by a horizontal bracket, a holding clamp for attachment of the apparatus to the horizontal bracket, a first swivel socket attached to said holding clamp, a horizontal member attached to said swivel socket, said horizontal member having a second swivel socket, a spine depending from said second swivel socket, a return panel attached to said spine, said holding clamp comprising an upper plate and a lower plate adapted to fit over said horizontal bracket, means to tighten said upper and lower plates against said horizontal bracket so as to clamp the return apparatus onto said horizontal bracket.

4. The apparatus of claim 3 in which said return panel is slidably held on said spine at about a 45 degree angle.

5. The apparatus of claim 3 in which said panel is comprised of an elastic material.

6. The apparatus of claim 3 in which said spine is rotatable 360 degrees.

7. The apparatus of claim 3 in which the return panel is attached to said spine by rotatable socket screws, allowing said return panel to rotate 360 degrees around said spine.

8. The apparatus of claim 3 in which said spine has four elbow joints allowing said spine to be rotated in two separate sections to provide further adjustment of the position of the return panel.

9. The apparatus of claim 8 in which said return panel has a horizontal support leg connected by socket screws, allowing said return panel to be disconnected from said spine for ease of portability.

10. A portable basketball return apparatus adapted to be attached to a rim attached to a backboard by a bracket, comprising, a holding clamp for attachment of the apparatus to the bracket, a spine attached to said holding clamp, a return panel attached to said spine, said holding clamp comprising an upper plate and a lower plate adapted to fit over said horizontal bracket, a screw passing through said lower plate, a ball joint attached to said screw, a flat plate attached to said ball joint, means to tighten said screw so as to clamp the return apparatus onto said bracket.

11. The apparatus of claims 3 or 10 further comprising a female receptacle in said spine, a pole with a male connector, which fits into said female receptacle to lift the apparatus onto said bracket.

12. The apparatus of claim 10 in which said return panel is slidably held on said spine at about a 45 degree angle.

13. The apparatus of claim 10 in which said pane, is comprised of an elastic material.

14. The apparatus of claim 10 in which said spine is rotatable 360 degrees.

15. The apparatus of claim 10 in which the return panel is attached to said spine by rotatable socket screws, allowing said return panel to rotate 360 degrees around said spine.

16. The apparatus of claim 10 in which said screw has a female receptacle which is turned by a pole having a male connector, for tightening said screw from the ground.

17. The apparatus of claim 10 in which said spine has four elbow joints allowing said spine to be rotated in two separate sections to provide further adjustment of the position of the return panel.

18. The apparatus of claim 10 in which said return panel has a horizontal support leg connected by socket screws, allowing said return panel to be disconnected from said spine for ease of portability.

19. A portable basketball return apparatus releasably attachable to a rim attached to a backboard by a horizontal bracket, a holding clamp for attachment of the apparatus to the horizontal bracket, a first swivel socket attached to said holding clamp, a horizontal member attached to said swivel socket, said horizontal member having a second swivel socket, a spine attached to said second swivel socket, a return panel attached to said spine, said holding clamp comprising an upper plate and a lower plate adapted to fit over said horizontal bracket, a screw passing through said lower plate, means to tighten said screw against said horizontal bracket so as to clamp the return apparatus onto said horizontal bracket.

20. The apparatus of claim 19 in which said screw has a female receptacle which is turned by a pole having a male connector, for tightening said screw from the ground.

* * * * *